US007013958B2

(12) United States Patent
Garner et al.

(10) Patent No.: US 7,013,958 B2
(45) Date of Patent: Mar. 21, 2006

(54) SINTERED GROOVED WICK WITH PARTICLE WEB

(75) Inventors: Scott D. Garner, Lititz, PA (US); James E. Lindemuth, Lititz, PA (US); Jerome E. Toth, Hatboro, PA (US); John H. Rosenfeld, Lancaster, PA (US); Kenneth G. Minnerly, Lititz, PA (US)

(73) Assignee: Thermal Corp., Wilmington, DE (US)

( * ) Notice: Subject to any disclaimer, the term of this patent is extended or adjusted under 35 U.S.C. 154(b) by 0 days.

(21) Appl. No.: 11/128,454

(22) Filed: May 13, 2005

(65) Prior Publication Data

US 2005/0236143 A1 Oct. 27, 2005

Related U.S. Application Data

(63) Continuation of application No. 10/422,878, filed on Apr. 24, 2003.

(51) Int. Cl.
*F28D 15/00* (2006.01)

(52) U.S. Cl. ..... 165/104.26; 165/104.21; 361/700; 174/15.2; 257/715

(58) Field of Classification Search ..... 165/104.26, 165/104.21, 104.33; 361/699, 700; 174/15.2; 257/714–716

See application file for complete search history.

(56) References Cited

U.S. PATENT DOCUMENTS

| | | | |
|---|---|---|---|
| 3,537,514 | A | 11/1970 | Levedahl |
| 3,598,180 | A | 8/1971 | Moore, Jr. |
| 3,613,778 | A | 10/1971 | Feldman, Jr. |
| 3,675,711 | A | 7/1972 | Bilinski et al. |
| 3,681,843 | A | 8/1972 | Arcella et al. |
| 3,788,388 | A | 1/1974 | Barkmann |
| 4,042,316 | A | 8/1977 | Rabe |
| 4,046,190 | A | 9/1977 | Marcus et al. |
| 4,118,756 | A | 10/1978 | Nelson et al. |
| 4,177,646 | A | 12/1979 | Guadagnin et al. |
| 4,231,423 | A | 11/1980 | Haslett |
| 4,274,479 | A | 6/1981 | Eastman |
| 4,327,752 | A | 5/1982 | Hickel |
| 4,354,482 | A | 10/1982 | Beisecker |
| 4,361,133 | A | 11/1982 | Bonnema |
| 4,365,851 | A | 12/1982 | Andres et al. |
| 4,366,526 | A | 12/1982 | Lijoi et al. |

(Continued)

OTHER PUBLICATIONS

Rosenfeld, J.H., "Nucleate Boiling Heat Transfer in Porous Wick Structures," ASME HTD vol. 108, *Heat Transfer Fundamentals, Design, Applications, and Operating Problems*, R.H. Shah, Ed., pp. 47-55, 1989.

(Continued)

*Primary Examiner*—Terrell McKinnon
(74) *Attorney, Agent, or Firm*—Duane Morris LLP

(57) ABSTRACT

A grooved sintered wick for a heat pipe is provided having a plurality of individual particles which together yield an average particle diameter. The grooved sintered wick further includes at least two adjacent lands that are in fluid communication with one another through a particle layer disposed between the lands where the particle layer comprises at least one dimension that is no more than about six average particle diameters. A heat pipe is also provided comprising a grooved wick that includes a plurality of individual particles having an average diameter. The grooved wick includes at least two adjacent lands that are in fluid communication with one another through a particle layer disposed between the lands that comprises less than about six average particle diameters. A method for making a heat pipe wick in accordance with the foregoing structures is also provided.

10 Claims, 4 Drawing Sheets

U.S. PATENT DOCUMENTS

| | | | |
|---|---|---|---|
| 4,374,528 | A | 2/1983 | Tittert |
| 4,382,448 | A | 5/1983 | Tittert |
| 4,489,777 | A | 12/1984 | Del Bagno et al. |
| 4,503,483 | A | 3/1985 | Basiulis |
| 4,557,413 | A | 12/1985 | Lewis et al. |
| 4,616,699 | A | 10/1986 | Grote |
| 4,641,404 | A | 2/1987 | Seydel et al. |
| 4,697,205 | A | 9/1987 | Eastman |
| 4,748,314 | A | 5/1988 | Desage |
| 4,765,396 | A | 8/1988 | Seidenberg |
| 4,777,561 | A | 10/1988 | Murphy et al. |
| 4,807,697 | A | 2/1989 | Gernert et al. |
| 4,819,719 | A | 4/1989 | Grote et al. |
| 4,830,097 | A | 5/1989 | Tanzer |
| 4,840,224 | A | 6/1989 | Dietzsch |
| 4,865,729 | A | 9/1989 | Saxena et al. |
| 4,880,052 | A | 11/1989 | Meyer, IV et al. |
| 4,883,116 | A | 11/1989 | Seidenberg et al. |
| 4,885,129 | A | 12/1989 | Leonard et al. |
| 4,912,548 | A | 3/1990 | Shanker et al. |
| 4,921,041 | A | 5/1990 | Akachi |
| 4,929,414 | A | 5/1990 | Leonard et al. |
| 4,931,905 | A | 6/1990 | Cirrito et al. |
| 4,960,202 | A | 10/1990 | Rice et al. |
| 4,982,274 | A | 1/1991 | Murase et al. |
| 5,059,496 | A | 10/1991 | Sindorf |
| 5,076,352 | A | 12/1991 | Rosenfeld et al. |
| 5,101,560 | A | 4/1992 | Leonard et al. |
| 5,103,897 | A | 4/1992 | Cullimore et al. |
| 5,148,440 | A | 9/1992 | Duncan |
| 5,160,252 | A | 11/1992 | Edwards |
| 5,200,248 | A | 4/1993 | Thompson et al. |
| 5,219,020 | A | 6/1993 | Akachi |
| 5,242,644 | A | 9/1993 | Thompson et al. |
| 5,253,702 | A | 10/1993 | Davidson et al. |
| 5,268,812 | A | 12/1993 | Conte |
| 5,283,715 | A | 2/1994 | Carlsten et al. |
| 5,320,866 | A | 6/1994 | Leonard |
| 5,331,510 | A | 7/1994 | Ouchi et al. |
| 5,333,470 | A | 8/1994 | Dinh |
| 5,349,237 | A | 9/1994 | Sayka et al. |
| 5,408,128 | A | 4/1995 | Furnival |
| 5,409,055 | A | 4/1995 | Tanaka et al. |
| 5,522,455 | A | 6/1996 | Brown et al. |
| 5,549,394 | A | 8/1996 | Nowak et al. |
| 5,642,776 | A | 7/1997 | Meyer et al. |
| 5,664,890 | A | 9/1997 | Nowak et al. |
| 5,711,816 | A | 1/1998 | Kirlin et al. |
| 5,769,154 | A | 6/1998 | Adkins et al. |
| 5,826,645 | A | 10/1998 | Meyer, IV et al. |
| 5,847,925 | A | 12/1998 | Progl et al. |
| 5,880,524 | A | 3/1999 | Xie |
| 5,883,426 | A | 3/1999 | Tokuno et al. |
| 5,947,193 | A | 9/1999 | Adkins et al. |
| 5,950,710 | A | 9/1999 | Liu |
| 6,041,211 | A | 3/2000 | Hobson et al. |
| 6,055,157 | A | 4/2000 | Bartilson |
| 6,056,044 | A | 5/2000 | Benson et al. |
| 6,082,443 | A | 7/2000 | Yamamoto et al. |
| 6,148,906 | A | 11/2000 | Li et al. |
| 6,154,364 | A | 11/2000 | Girrens et al. |
| 6,158,502 | A | 12/2000 | Thomas |
| 6,167,948 | B1 | 1/2001 | Thomas |
| 6,169,852 | B1 | 1/2001 | Liao et al. |
| 6,227,287 | B1 | 5/2001 | Tanaka et al. |
| 6,230,407 | B1 | 5/2001 | Akutsu |
| 6,239,350 | B1 | 5/2001 | Sievers et al. |
| 6,256,201 | B1 | 7/2001 | Ikeda et al. |
| 6,293,333 | B1 | 9/2001 | Ponnappan et al. |
| 6,302,192 | B1 | 10/2001 | Dussinger et al. |
| 6,303,081 | B1 | 10/2001 | Mink et al. |
| 6,382,309 | B1 | 5/2002 | Kroliczek et al. |
| 6,388,882 | B1 | 5/2002 | Hoover et al. |
| 6,397,935 | B1 | 6/2002 | Yamamoto et al. |
| 6,418,017 | B1 | 7/2002 | Patel et al. |
| 6,536,510 | B1 | 3/2003 | Khrustalev et al. |

OTHER PUBLICATIONS

Rosenfeld, J.H. and J.E. Lindemuth, "Acetone Heat Pipes for Stirling Orbiter Refrigerator/Freezer," Contact G350240J70—final report to GE Gov't. Service, Apr. 16, 1993.

McDonald, K.E., Berchowitz, D., Rosenfeld, J.H., and Lindemuth, J.E., "Stirling Refrigerator for Space Shuttle Experiments," Proc. 29$^{th}$IECEC, paper 94-4179, pp. 1807-1812, 1994.

Lindemuth, J.E., "Stainless Steel/Propylene Heat Pipe Interface for Stirling Orbiter Refrigerator/Freezer," NASA LeRC final report, PO. No. C-76546-F, Apr. 21, 1998.

Rosenfeld, J.H. and Lindemuth, J.E., "Heat Transfer in Sintered Groove Heat Pipes," International Heat Pipe Conference, 1999.

Rosenfeld, J.H. and North, M. T., "Porous Media Heat Exchangers for Cooling of High-Power Optical Components," *Optical Engineering*, vol. 34, No. 2, pp. 335-341, Feb. 1995.

Rosenfeld, J.H., Toth, J.E., and Phillips, A.L., "Emerging Applications for Porous Media Heat Exchangers," Proc. Int. Conf. on Porous Media and Their Applications in Science, Eng., and Industry Kona HI, Jun. 16-21, 1996.

SINTERED GROOVED WICK WITH PARTICLE WEB

This application is a continuation application of copending U.S. application Ser. No. 10/422,878 filed on Apr. 24, 2003.

FIELD OF THE INVENTION

The present invention generally relates to the management of thermal energy generated by electronic systems, and more particularly to a heat pipe-related device and method for efficiently and cost effectively routing and controlling the thermal energy generated by various components of an electronic system.

BACKGROUND OF THE INVENTION

Semiconductors are continuously diminishing in size. Corresponding to this size reduction is an increase in the power densities of semiconductors. This, in turn, creates heat proliferation problems which must be resolved because excessive heat will degrade semiconductor performance. Heat pipes are known in the art for both transferring and spreading heat that is generated by electronic devices.

Heat pipes use successive evaporation and condensation of a working fluid to transport thermal energy from a heat source to a heat sink. Heat pipes can transport very large amounts of thermal energy in a vaporized working fluid, because most working fluids have a high heat of vaporization. Further, the thermal energy can be transported over relatively small temperature differences between the heat source and the heat sink. Heat pipes generally use capillary forces created by a porous wick to return condensed working fluid from a heat pipe condenser section (where transported thermal energy is given up at the heat sink) to an evaporator section (where the thermal energy to be transported is absorbed from the heat source). Heat spreader heat pipes can help improve heat rejection from integrated circuits. A heat spreader is a thin substrate that absorbs the thermal energy generated by, e.g., a semiconductor device, and spreads the energy over a large surface of a heat sink.

Heat pipe wicks for cylindrical heat pipes are typically made by wrapping metal screening of felt metal around a cylindrically shaped mandrel, inserting the mandrel and wrapped wick inside the heat pipe container, and then removing the mandrel. Wicks have also been formed by depositing a metal powder onto the interior surfaces of the heat pipe, whether flat or cylindrical, and then sintering the powder to create a very large number of intersticial capillaries. Typical heat pipe wicks are particularly susceptible to developing hot spots where the liquid condensate being wicked back to the evaporator section boils away and impedes or blocks liquid movement. In many prior art heat pipes, this hot spot effect is substantially minimized by maintaining the average thickness of the wick within relatively close tolerances.

Powder metal wick structures in prior art heat pipes have several well documented advantages over other heat pipe wick structures. One draw back to these wicks, however, is their relatively low effective thermal conductivity compared their base metal, referred to in the art as their "delta-T". Traditional sintered powder metal wicks have a thermal conductivity that is typically an order of magnitude less than the base metal from which they are fabricated. In a conventional smooth wick heat pipe, there are two modes of operation depending upon the heat flux at the evaporator.

The first mode occurs at lower heat fluxes, in which heat is conducted through the wick with the working fluid evaporating off of the wick surface. The second mode occurs at higher heat fluxes, in which the temperature gradient required to conduct the heat through the relatively low conductivity wick becomes large enough so that the liquid contained in the wick near the heat pipe enclosure wall becomes sufficiently superheated that boiling is initiated within the wick itself. In this second mode, vapor bubbles are formed at and near wall/wick interface and subsequently travel through the wick structure to the vapor space of the heat pipe. This second mode of heat transfer can be very efficient and results in a lower over all wick delta-T than the first, conduction mode. Unfortunately, the vapor bubbles exiting the wick displace liquid returning to the evaporator area leading to premature dry out of the evaporator portion of the wick.

Ideally, a wick structure should be thin enough that the conduction delta-T is sufficiently small to prevent boiling from initiating. Thin wicks, however, have not been thought to have sufficient cross-sectional area to transport the large amounts of liquid required to dissipate any significant amount of power. For example, the patent of G. Y. Eastman, U.S. Pat. No. 4,274,479, concerns a heat pipe capillary wick structure that is fabricated from sintered metal, and formed with longitudinal grooves on its interior surface. The Eastman wick grooves provide longitudinal capillary pumping while the sintered wick provides a high capillary pressure to fill the grooves and assure effective circumferential distribution of the heat transfer liquid. Eastman describes grooved structures generally as having "lands" and "grooves or channels". The lands are the material between the grooves or channels. The sides of the lands define the width of the grooves. Thus, the land height is also the groove depth. Eastman also states that the prior art consists of grooved structures in which the lands are solid material, integral with the casing wall, and the grooves are made by various machining, chemical milling or extrusion processes. Significantly, Eastman suggests that in order to optimize heat pipe performance, his lands and grooves must be sufficient in size to maintain a continuous layer of fluid within a relatively thick band of sintered powder connecting the lands and grooves such that a reservoir of working fluid exists at the bottom of each groove. Thus, Eastman requires his grooves to be blocked at their respective ends to assure that the capillary pumping pressure within the groove is determined by its narrowest width at the vapor liquid interface. In other words, Eastman suggests that these wicks do not have sufficient cross-sectional area to transport the relatively large amounts of working fluid that is required to dissipate a significant amount of thermal energy.

SUMMARY OF THE INVENTION

The present invention provides a grooved sintered wick for a heat pipe comprising a plurality of individual particles which together yield an average particle diameter. The grooved sintered wick further includes at least two lands that are in fluid communication with one another through a particle layer disposed between at least two lands where the particle layer comprises at least one dimension that is no more than about six average particle diameters. In this way, vapor bubbles are not formed at a wall/wick interface to subsequently travel through the wick structure to the vapor space of the heat pipe. This mode of heat transfer is very efficient and results in a lower over all wick delta-T.

A heat pipe is also provided comprising an enclosure having an internal surface and a working fluid that is disposed within the enclosure. A grooved wick is disposed on at least a portion of the internal surface that includes a plurality of individual particles having an average diameter. The grooved wick includes at least two lands that are in fluid communication with one another through a particle layer disposed between the at least two lands that comprises less than about six average particle diameters.

A method for making a heat pipe wick on an inside surface of a heat pipe container is also presented where a mandrel having a grooved contour is positioned within a portion of a heat pipe container. A slurry of metal particles is provided having an average particle diameter and that are suspended in a viscous binder. At least part of the inside surface of the container is then coated with the slurry so that the slurry conforms to the grooved contour of the mandrel and forms a layer of slurry between adjacent grooves that comprises no more than about six average particle diameters. The slurry is dried to form a green wick, and then heat treated to yield a final composition of the heat pipe wick.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
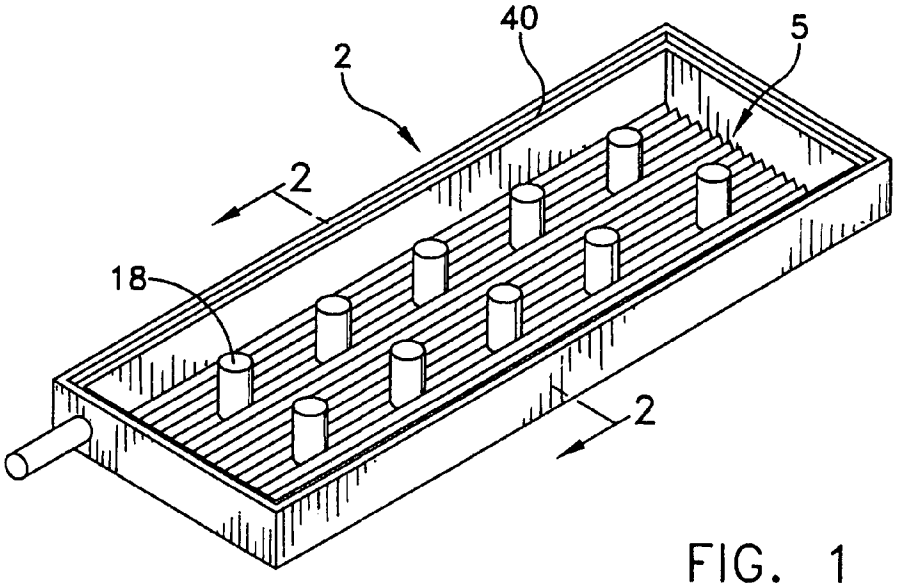
FIG. 1 is a perspective view of a heat pipe heat spreader formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Figure 2:
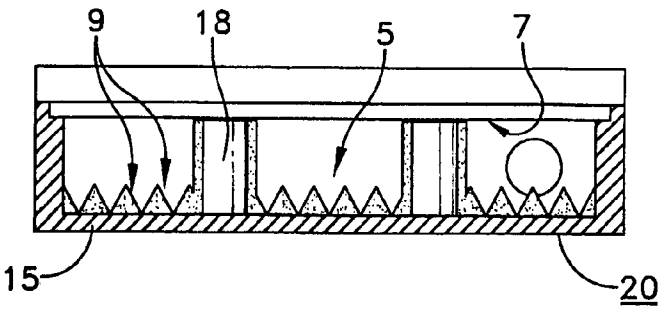
FIG. 2 is a cross-sectional view of the heat pipe heat spreader shown in FIG. 1, as taken along lines 2—2 in FIG. 1.
Figure 3:
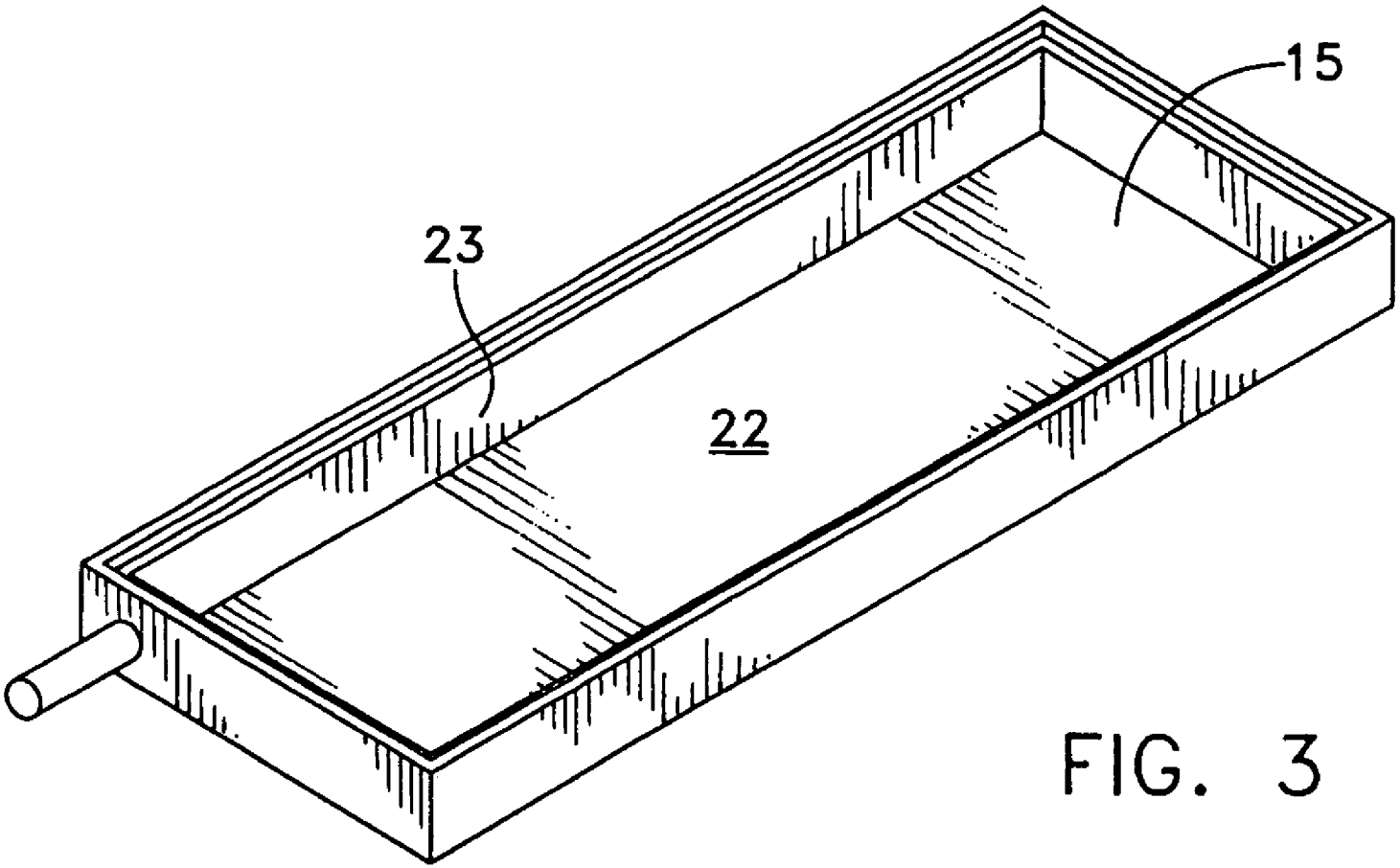
FIG. 3 is a perspective view of a container used to form the heat pipe heat spreader shown in FIGS. 1 and 2.

Referring to FIGS. 1 and 2, the present invention comprises a heat pipe heat spreader 2 that is sized and shaped to transfer and spread the thermal energy generated by at least one thermal energy source, e.g., a semiconductor device (not shown), that is thermally engaged with a portion of heat pipe heat spreader 2. Heat pipe heat spreader 2 comprises an evaporator section 5, a condenser section 7, and a sintered and grooved wick 9. Although heat pipe heat spreader 2 may be formed as a planar, rectangular structure, it may also be convenient for heat pipe heat spreader 2 to comprise a circular or rectangular tubular structure. In a planar rectangular heat pipe heat spreader 2, a vapor chamber is defined between a bottom wall 15 and a top wall (not shown), and extends transversely and longitudinally throughout heat pipe heat spreader 2. Posts 18 may be included to maintain structural integrity.

In one preferred embodiment, bottom wall 15 and a top wall comprise substantially uniform thickness sheets of a thermally conductive material, e.g., copper, steel, aluminum, or any of their respective alloys, and are spaced-apart by about 2.0 (mm) to about 4.0 (mm) so as to form the void space within heat pipe heat spreader 2 that defines a vapor chamber. The top wall of heat pipe heat spreader 2 is often substantially planar, and is complementary in shape to bottom wall 15. In the following description of the preferred embodiments of the present invention, evaporator section 5 will be associated with bottom wall 15 and condenser section 7 will be associated with those portions of heat pipe heat spreader 2 that do not comprise a grooved wick, e.g. a top wall or side walls. It will be understood, however, that such an arrangement with regard to the structure of the metal envelope that defines heat pipe heat spreader 2 is purely arbitrary, i.e., may be reversed or otherwise changed, without departing from the scope of the invention.

Bottom wall 15 preferably comprises a substantially planer outer surface 20, an inner surface 22, and a peripheral edge wall 23. Peripheral edge wall 23 projects outwardly from the peripheral edge of inner surface 22 so as to circumscribe inner surface 22. A vapor chamber is created within heat pipe heat spreader 2 by the attachment of bottom wall 15 and a top wall, along their common edges which are then hermetically sealed at their joining interface 40. A two-phase vaporizable liquid (e.g., water, ammonia or freon not shown) resides within the vapor chamber, and serves as the working fluid for heat pipe heat spreader 2. Heat pipe heat spreader 2 is completed by drawing a partial vacuum within the vapor chamber after injecting the working fluid just prior to final hermetic sealing of the common edges of bottom wall 15 and the top wall. For example, heat pipe heat spreader 2 may be made of copper or copper silicon carbide with water, ammonia, or freon generally chosen as the two-phase vaporizable liquid.

Figure 4:
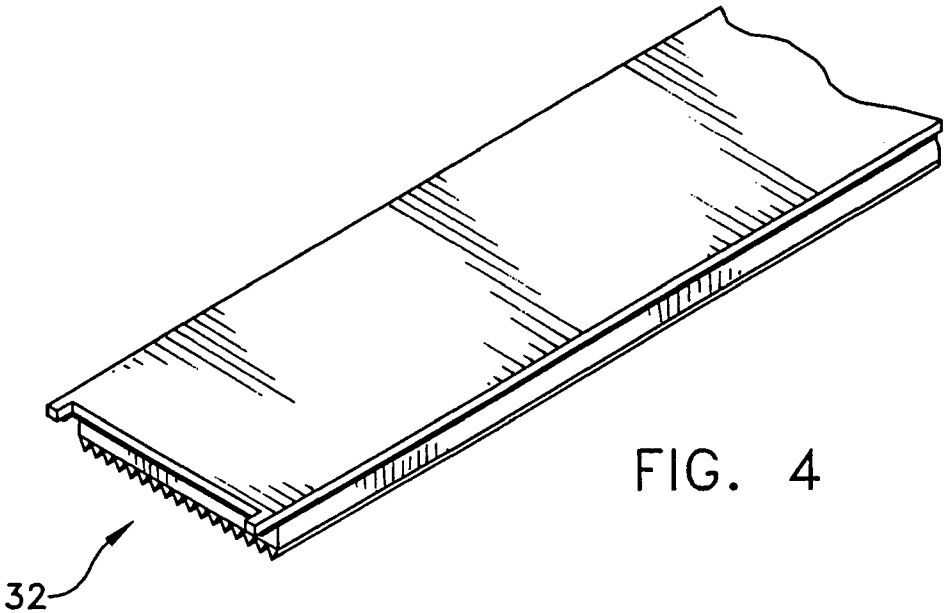
FIG. 4 is a perspective, broken-way view of a mandrel used to form a grooved wick in accordance with the present invention.
Figure 5:
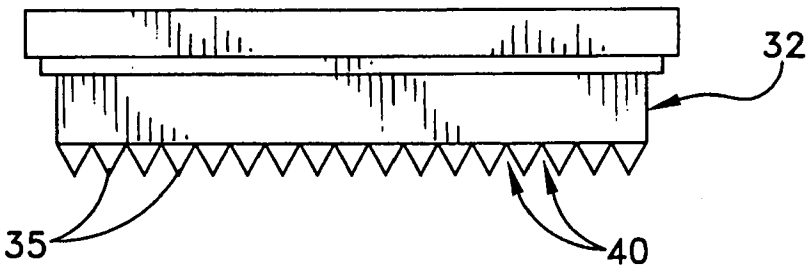
FIG. 5 is an end view of the mandrel shown in FIG. 4.
Figure 6:
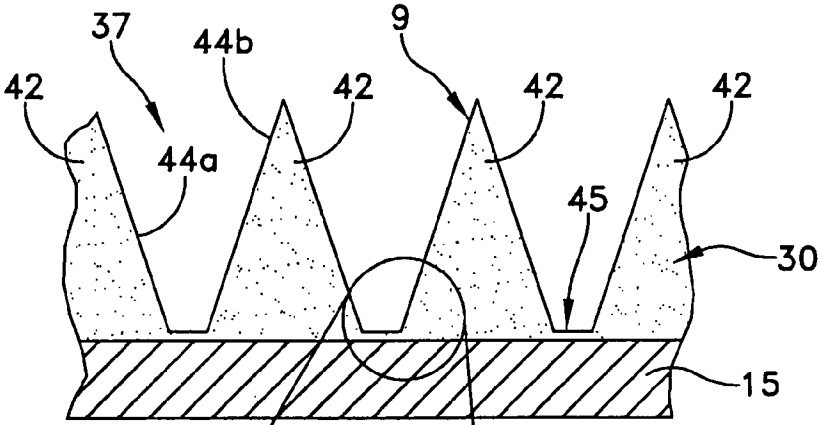
FIG. 6 is a broken-way, enlarged view of a portion of the bottom wall of a container shown in FIGS. 1 and 2.
Figure 7:
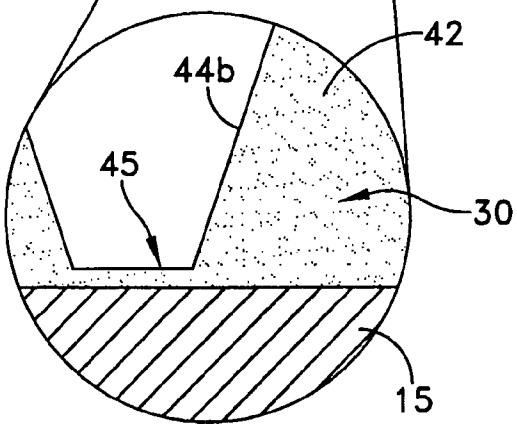
FIG. 7 is a significantly enlarged view of a portion of the groove-wick disposed at the bottom of the heat pipe heat spreader in FIGS. 1 and 2, showing an extremely thin wick structure disposed between individual lands of the wick.

Referring to FIGS. 1, 2, and 6, 7, sintered grooved wick 9 is located on inner surface 22 of bottom wall 15, and is formed from metal powder 30 that is sintered in place around a shaped mandrel 32 (FIG. 4) to form grooved wick 9. Lands 35 of mandrel 32 form grooves 37 of finished wick 9, and grooves 40 of mandrel 32 form lands 42 of wick 9. Each land 42 is formed as an inverted, substantially "V"-shaped or pyramidal protrusion having sloped side walls 44*a*, 44*b*, and is spaced-apart from adjacent lands. Grooves 37 separate lands 42 and are arranged in substantially parallel, longitudinally (or transversely) oriented rows that extend at least through evaporator section 5. The terminal portions of grooves 37, adjacent to peripheral edge wall 23, may be unbounded by further porous structures. Advantageously, a relatively thin layer of sintered powder 30 is deposited upon inner surface 22 of bottom wall 15 so as to form a groove-wick 45 at the bottom of each groove 37 and between spaced-apart lands 42. Sintered powder 30 may be selected from any of the materials having high thermal conductivity and that are suitable for fabrication into porous structures, e.g., carbon, tungsten, copper, aluminum, magnesium, nickel, gold, silver, aluminum oxide, beryllium oxide, or the like, and may comprise either substantially spherical, arbitrary or regular polygonal, or filament-shaped particles of varying cross-sectional shape. For example, sintered copper powder 30 is deposited between lands 42 such that groove-wick 45 comprises an average thickness of about one to six average copper particle diameters (approximately 0.005 millimeters to 0.5 millimeters, preferably, in the range from about 0.05 millimeters to about 0.25 millimeters) when deposited over substantially all of inner surface 22 of bottom wall 15, and between sloped side walls 44*a*, 44*b* of lands 42. Of course, other wick materials, such as, aluminum-silicon-carbide or copper-silicon-carbide may be used with similar effect.

Significantly groove-wick 45 is formed so as to be thin enough that the conduction delta-T is small enough to prevent boiling from initiating at the interface between inner surface 22 of bottom wall 15 and the sintered powder forming the wick. Groove-wick 45 is an extremely thin wick structure that is fed by spaced lands 42 which provide the required cross-sectional area to maintain effective working fluid flow. In cross-section, groove-wick 45 comprises an optimum design when it comprises the largest possible (limited by capillary limitations) flat area between lands 42. This area should have a thickness of, e.g., only one to six copper powder particles. The thinner groove-wick 45 is, the better performance within realistic fabrication constraints, as long as the surface area of inner surface 22 has at least one layer of copper particles. This thin wick area takes advantage of the enhanced evaporative surface area of the groove-wick layer, by limiting the thickness of groove-wick 45 to no more than a few powder particles. This structure has been found to circumvent the thermal conduction limitations associated with the prior art.

It is to be understood that the present invention is by no means limited only to the particular constructions herein disclosed and shown in the drawings, but also comprises any modifications or equivalents within the scope of the claims.

What is claimed is:

1. A grooved sintered wick for a heat pipe comprising a plurality of individual particles which together yield an average particle diameter, and including at least two adjacent lands that are in fluid communication with one another through a particle layer disposed between said at least two adjacent lands wherein said particle layer comprises at least one dimension that is no more than about six average particle diameters.

2. A grooved sintered wick for a heat pipe according to claim 1 wherein said layer comprises a thickness that is about three average particle diameters.

3. A grooved sintered wick for a heat pipe according to claim 1 wherein said particles are formed substantially of copper.

4. A grooved sintered wick for a heat pipe according to claim 1 wherein said six average particle diameters is within a range from about 0.05 millimeters to about 0.25 millimeters.

5. A heat pipe comprising:

an enclosure having an internal surface;

a working fluid disposed within said enclosure; and a grooved wick disposed on at least a portion of said internal surface and including a plurality of individual particles having an average diameter, said grooved wick including at least two adjacent lands that are in fluid communication with one another through a particle layer disposed between said at least two adjacent lands that comprises less than about six average particle diameters.

6. A heat pipe according to claim 5 wherein said particle layer comprises a thickness that is less than about three average particle diameters.

7. A heat pipe according to claim 5 wherein said particles are formed substantially of copper.

8. A heat pipe according to claim 5 wherein six average particle diameters is within a range from about 0.005 millimeters to about 0.5 millimeters.

9. A grooved sintered wick for a heat pipe comprising a plurality of individual particles which together yield an average particle diameter, and including at least two spaced-apart lands that are in fluid communication with one another through a particle layer disposed between said at least two spaced-apart lands wherein said particle layer comprises at least one dimension that is no more than about six average particle diameters.

10. A heat pipe comprising:

an enclosure having an internal surface;

a working fluid disposed within said enclosure; and a grooved wick disposed on at least a portion of said internal surface and including a plurality of individual particles having an average diameter, said grooved wick including at least two spaced-apart lands that are in fluid communication with one another through a particle layer disposed between said at least two spaced-apart lands that comprises less than about six average particle diameters.

* * * * *